United States Patent [19]

Kato et al.

[11] Patent Number: 4,782,732

[45] Date of Patent: Nov. 8, 1988

[54] SPLIT TREMOLO DEVICE

[75] Inventors: Hisashi Kato; Daiji Okai, both of Tokyo; Nobuyuki Yoshiba, Saitama; Yukihisa Yuasa, Chiba, all of Japan

[73] Assignee: Kabushiki Kaisha Arai Gakkiten, Japan

[21] Appl. No.: 170,798

[22] Filed: Mar. 21, 1988

[30] Foreign Application Priority Data

Mar. 23, 1987 [JP] Japan ..... 62-68643

[51] Int. Cl.[4] ..... G10D 3/12

[52] U.S. Cl. ..... 84/313

[58] Field of Search ..... 84/267, 298, 299, 307, 84/313

[56] References Cited

U.S. PATENT DOCUMENTS 3,250,167 5/1966 Porter ..... 84/313

3,479,917 11/1969 Zitnik et al. ..... 84/312 R 4,383,466 5/1983 Shibuya ..... 84/313

*Primary Examiner*—Lawrence R. Franklin

*Attorney, Agent, or Firm*—Steele, Gould & Fried

[57] ABSTRACT

To the end of obtaining favorable vibrato effects, provided is a tremolo device for stringed musical instruments comprising a string support assembly consisting of at least two individually pivoted segments, each individually carrying a string anchoring member, a spring for biasing the string support assembly segment in the direction for applying a tension to the string and a handle bar for pivoting the segment against the biasing force of the spring in the direction to reduce the tension of the string. By selectively or jointly moving the handle bars of the different segments, hitherto unknown special vibrato effects can be created. Optionally, a provision may be made so that the different segments may be coupled into a single body for producing conventional vibrato effects. Since the string support assembly is segmented, breakage of any single string will only affect the corresponding segment and not the other segment, the tuning process subsequent to the replacement of the broken string can be facilitated.

6 Claims, 5 Drawing Sheets

SPLIT TREMOLO DEVICE

TECHNICAL FIELD

The present invention relates to a tremolo device for use in stringed musical instruments such as guitars having a plurality of strings for achieving a wide variety of free playing effects, and more particularly to means for producing vibrato effects in such stringed musical instruments.

BACKGROUND OF THE INVENTION

Stringed musical instruments are generally provided with tuning means for adjusting the tension of their strings to a desired level, typically, by slightly varying the tension of the strings or adjusting the distance between the bridges which support the strings at their ends. Some of the stringed musical instruments, such as electric guitars, are additionally provided with vibrato means for varying the tension of the strings during performance without upsetting the tuned state of the strings to produce vibrato effects.

FIGS. 1 through 4 of the appended drawings illustrate a conventional electric guitar and a tremolo or vibrato assembly 3 provided therein. These and other drawings appended to this application illustrate the guitar as it is placed flatly on a flat surface or as seen by the player of the guitar. Therefore, a guitar which is being played will be seen inverted from the illustrated attitude to a beholder standing in front of the guitar.

A set 2 of strings *2a, 2b, 2c, 2d, 2e* and *2f* are anchored at opposite ends 3 and 4 of a guitar body 1 by the vibrato assembly 3 and a tension adjusting assembly 5, respectively. The strings 2 can be tuned by turning the corresponding knobs *5a*. The tension of the strings 2 can be varied also by rocking a lever arm 6 provided in the vibrato assembly 3 during performance.

The vibrato assembly 3 is now described in detail with reference to FIGS. 2 through 4. One end of each of the strings 2 is passed through a bridge 9 having a rectangular annular shape. These bridges 9 are movably mounted on a bridge base plate 7 or string support member so as to be adjustable of their heights with respect to the major surface of the guitar body 1 and of their positions along the lengthwise direction of the strings 2. The strings 2 are each further passed through a weight 8 which is fixedly secured to the bridge base plate 7 and are each fixed to the free end of the weight 8 which is received in a common cavity of the guitar body 1. The bridge base plate 7 is hinged to the guitar body 1 by way of screw heads 10 so as to be able to move away from and toward the guitar body 1. The free end of the weight 8 is coupled to internal parts of the cavity in the guitar body 1 by way of tension coil springs 11 so that the bridge base plate 7 is urged toward the guitar body 1 against the tension of the strings 2 as shown in FIG. 3. The lever arm of the handle bar 6 is fixedly attached to the bridge base plate 7 and extends towards the tension adjusting assembly 5, passing the screw heads 10 on which the base plate 7 is hinged.

When the handle bar 6 is pressed towards the guitar body 1, the bridge base plate 7 is swung away from the guitar body 1 against the tension of the tension coil springs 11, thereby slightly moving the bridges 9 towards the tension adjusting assembly 5 and slightly reducing the tension of the strings 2 as shown in FIG. 4. A vibrato effect can be produced by repeatedly alternating these tensioned and loosened conditions of the strings 2 at a desired rate and stroke. In this conventional vibrato assembly, since all of the strings 2 are anchored under tension to the bridges 9 which are secured to a common moveable bridge base plate 7, moving the bridge base plate 7 with the handle bar 6 causes the tension of all the strings 2 to vary only in unison and by a same degree.

Further, since all of the strings 2 are anchored under tension to a common moveable bridge base plate 7, when one of the strings is cut off during performance, the bridge base plate 7 is slightly displaced because the tension it receives from the strings is reduced by the contribution of the cut string to the total tension before it is cut off, the remaining strings are brought slightly out of tune and the player may find it difficult to continue his performance with the remaining strings.

After the broken string is replaced with a new one, all of the strings have to be tuned again and this process takes a long period of time because not only the new string but also the remaining strings are required to be tuned.

Meanwhile, there have recently arisen demands for guitars capable of effecting a wide range of adjustment of string tension for a freer, more sophisticated, and novel playing effects.

BRIEF SUMMARY OF THE INVENTION

In view of such shortcomings of the prior art stringed instruments and recent demands for more versatile devices for adjusting string tension of stringed musical instruments, a primary object of the present invention is to provide a device for adjusting string tension of stringed musical instruments which offers a hitherto unavailable freedom in producing vibrato effects.

A second object of the present invention is to provide a device for adjusting string tension of stringed musical instruments which, even when one of the strings is broken, can keep at least some of the remaining strings in tune.

A third object of the present invention is to provide a device for adjusting string tension of stringed musical instruments which is simple in structure but can offer much freedom in producing vibrato effects.

A fourth object of the present invention is to provide a device for adjusting string tension of stringed musical instruments which can offer much freedom in producing vibrato effects and, if desired, can be used in the same way as a conventional device.

These and other objects of the present invention can be accomplished by providing a device for adjusting string tension for stringed musical instruments, comprising: a string support assembly pivotally mounted on a musical instrument body; a plurality of string anchoring means, each anchoring an end of a string, mounted on the string support assembly, the string support assembly being pivoted so as to permit a displacement of the string anchoring means along the lengthwise direction of the strings; spring means for biasing the string support assembly in a direction to apply a tension to the strings; handle means for displacing the string support assembly against the biasing force of the spring means in a direction to cause a slight reduction in the tension of the strings; the string support members comprising at least two individually pivoted segments, each carrying at least one of the string anchoring means, one of the spring means and one of the handle means.

The present invention thus provides a vibrato assembly for stringed musical instruments which offers a hitherto unavailable freedom in producing vibrato effects and, even when one of the strings is broken, can keep at least some of the remaining strings in tune.

Preferably, the two segments of the string support assembly are pivoted by a common pivot center line extending perpendicularly to the strings and the string anchoring means comprise means for adjusting the tension of the corresponding individual strings.

In particular, if the handle means comprise a pair of lever arms, attached to the different segments of the string support assembly and extending substantially parallel to the strings, one of the lever arms being longer than the other, the player will find the lever arms easy to operate since these lever arms can be reached without substantially moving his arm away from the strings.

If means for selectively locking up two or more of the segments of the string support assembly into a single body is provided, the conventional vibrato effects can be produced if desired and the versatility of the stringed musical instrument provided with this novel string support assembly is enhanced.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
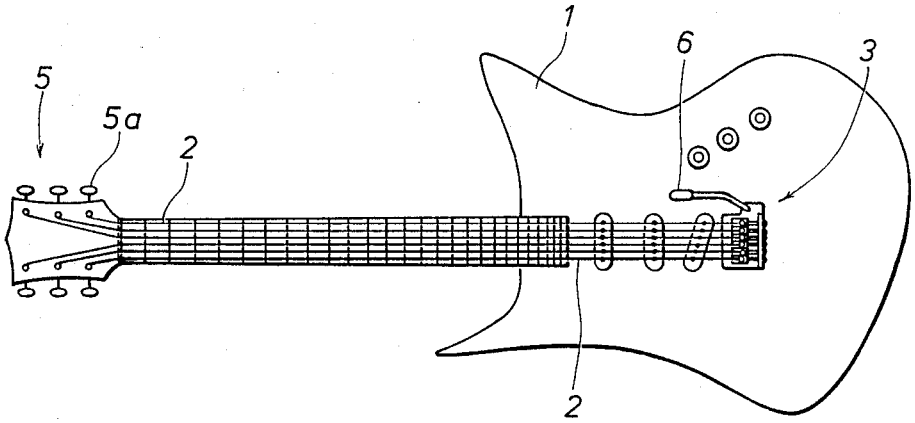
FIG. 1 is a plan view of a conventional electric guitar as placed on a flat surface.
Figure 2:
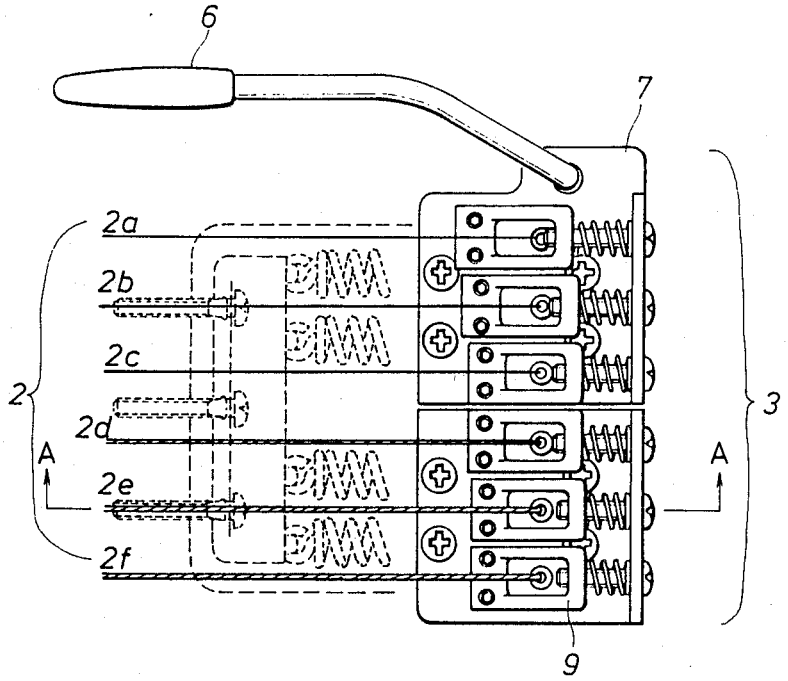
FIG. 2 is an enlarged fragmentary view of a part of the conventional electric guitar.
Figure 3:
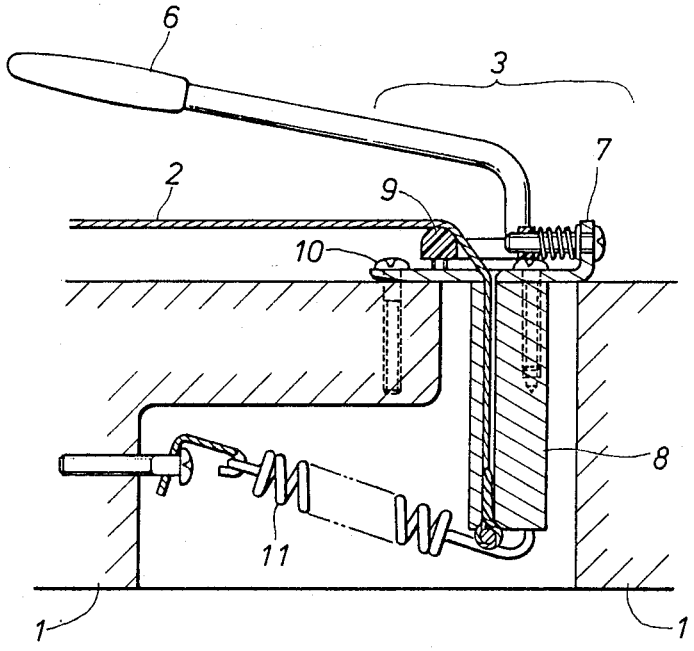
FIGS. 3 and 4 are sectional views taken along line A—A of FIG. 2, showing two different states of the vibrato assembly.
Figure 4:
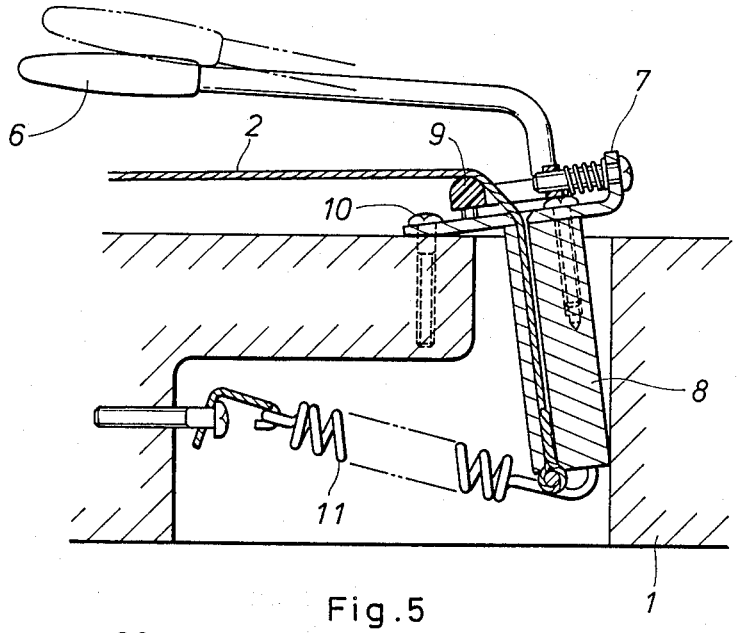
Figure 5:
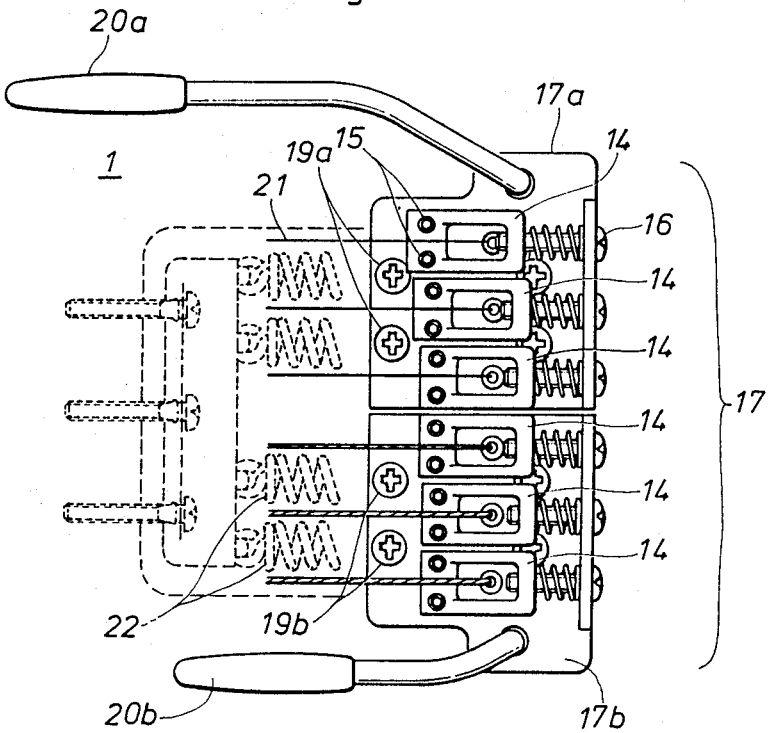
FIG. 5 is a view similar to FIG. 2 showing a first embodiment of the present invention.

FIG. 5 shows a device for adjusting the tension of the strings of an electric guitar or a vibrato assembly according to the present invention which generally corresponds to the part denoted with numeral 3 in regards to the conventional electric guitar 1 shown in FIG. 1. Six strings 2 are anchored under tension at their one ends by a bridge base plate assembly 17 or a string support assembly, each by way of a bridge 14 or a string support element. Each of the bridges 14 is provided with a string height adjusting screw 15 and a string length adjusting screw 16 for adjusting its height and length, respectively. The bridge base plate assembly 17 is divided into a first segment 17*a* to which the first, the second and the third strings are secured by way of the corresponding bridges 14, and a second segment 17*b* to which the fourth, the fifth and the sixth strings are secured by way of the corresponding bridges 14. The two segments 17*a* and 17*b* of the bridge base plate assembly 17 are supported on a guitar body 1 for independent swinging motion about respective screw heads 19*a* and 19*b* between the two positions for achieving the loosened and the tensioned state of the strings 2.

The bridge base plate assembly 17 is biased towards the guitar body 1 by means of tension coil springs 22 so as to normally keep the strings 2 in the tensioned state, as was the case with the prior art electric guitar shown in FIGS. 1 through 4.

Lever arms or handle bars 20*a* and 20*b* are attached respectively to the different segments 17*a* and 17*b* of the bridge base plate assembly 17 for independent or simultaneous rocking motion of the bridge base plate assembly segments 17*a* and 17*b* about the screw heads 19*a* and 19*b* which in effect define a common line about which the different segments 17*a* and 17*b* of the bridge base plate assembly 17 undergo the pivoting motion.

Operation of this embodiment is now described in the following.

First of all, the normal tuning procedure is described with reference to the convention electric guitar shown FIG. 1 which is not different from the guitar of the present embodiment except for the structure of the vibrato assembly 3.

The strings 2 are tuned by turning the knobs 5*a* of the tension adjusting assembly 5, or the string height adjusting screws 15 and the string length adjusting screws 16 which are shown in FIG. 5. During performance, the first segment 17*a* of the bridge base plate assembly 17 supporting the first, the second and the third string, and the second segment 17*b* of the bridge base plate assembly 17 supporting the fourth, fifth, and the sixth string are selectively or simultaneously swung repeatedly by means of the respective handle bars 20*a* and 20*b*, to thereby vary the tension of the strings for producing desired vibrato effects on either one of the groups of the strings 2 or both groups of the strings 2.

Even when one of the strings 2, for example the first string, is cut off during performance, the tension of the fourth through sixth strings is not affected and these strings will remain tuned since the bridge base plate segment 17*b* is separate from the bridge base plate segment 17*a* to which the first string belongs. Therefore, the performance of the guitar can be continued to a certain extent. When the first string is replaced with a new one, since only the first through the third strings are required to be tuned again, the tuning process can be accomplished in a short period of time.

Figure 6:
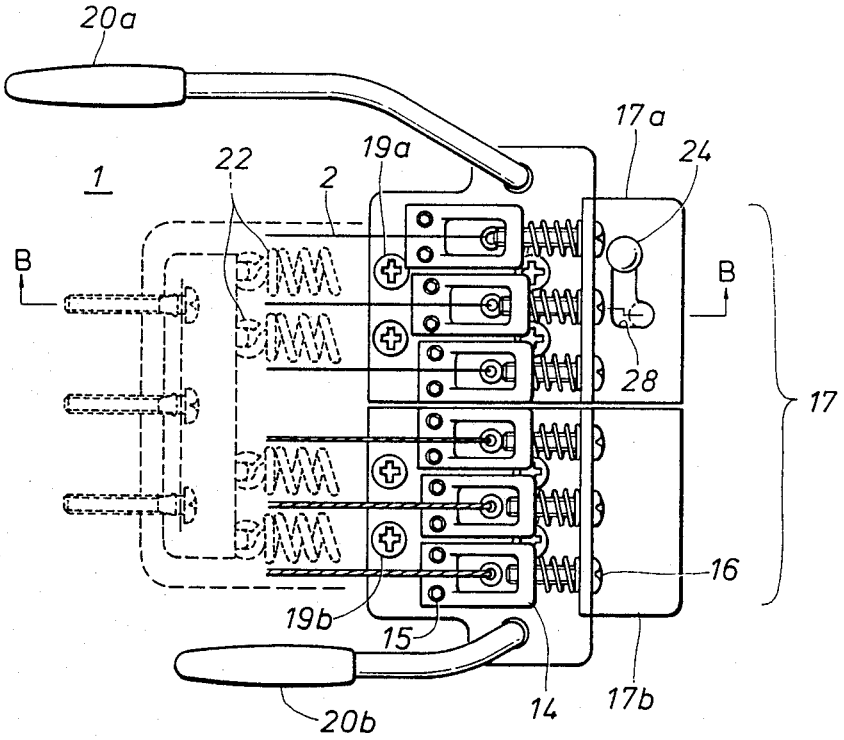
FIG. 6 is a view similar to FIG. 2 showing a second embodiment of the present invention.
Figure 7:
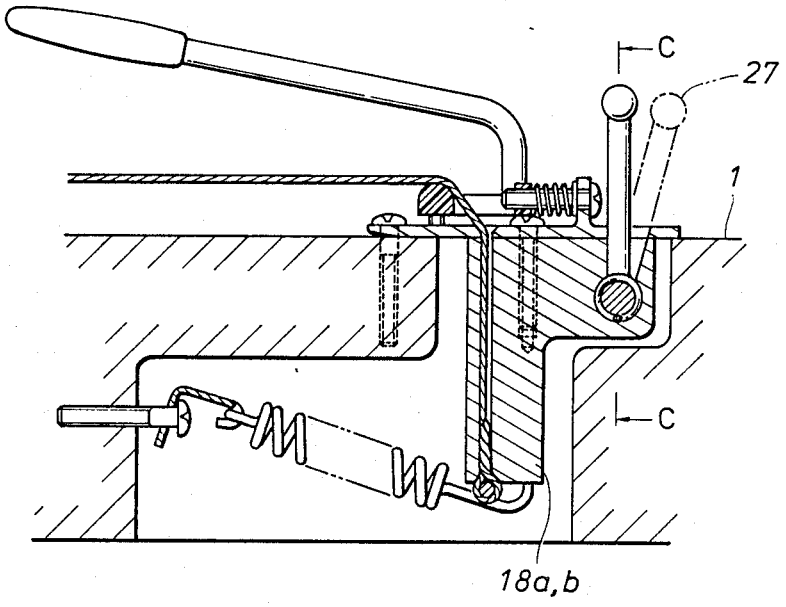
FIG. 7 is a sectional view taken along line B—B of FIG. 6.
Figure 8:
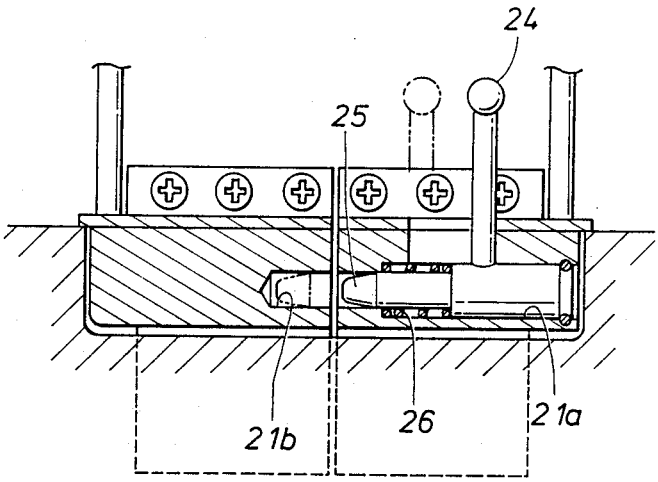
FIG. 8 is a sectional view taken along line C—C of FIG. 6.

FIGS. 6 through 8 show a second embodiment of the present invention. According to this second embodiment, the bridge base plate segment 17*a* and the bridge base plate segment 17*b* which are independently pivoted from each other about a common pivot center line can be selectively connected and disconnected by moving a connector pin 25 which is slidably received in a hole 21*a* provided in one of the bridge base plate segment 17*a* in and out of another hole 21*b* provided in the other bridge base plate segment 17*b* in alignment with the first hole 21*a*, by means of an arm 24 which is guided in an L-shaped slot 28. The other structural details of this embodiment are identical to those of the embodiment of FIG. 5, and identical parts are denoted with like reference numerals.

The connector pin 25 is normally urged by a compression coil spring 26 to the position indicated by the solid line in FIG. 8, with the connector pin 25 fully out of the hole 21*b*. Therefore, two bridge base plate segments 17*a* and 17*b* are disconnected from each other for independent motion. The connector pin 25 can be moved into the hole 25 against the biasing force of the compression coil spring 26 by means of the arm 24 and can be fixed therein with the arm 24 engaged to a corner in the slot 28 as indicated by the imaginary line in FIG. 6. In this state, the bridge base plate segments 17*a* and 17*b* can not swing independently but can swing only in unison.

The second embodiment operates as follows: In addition to the operation of the first embodiment, when it is necessary to give all the strings 2 a simultaneous vibrato effect, the two base plate segments 17*a* and 17*b* are connected to each other by the connector pin 25 and can be simultaneously operated by rocking only either one of the handle bars 20*a* and 20*b*.

Figure 9:
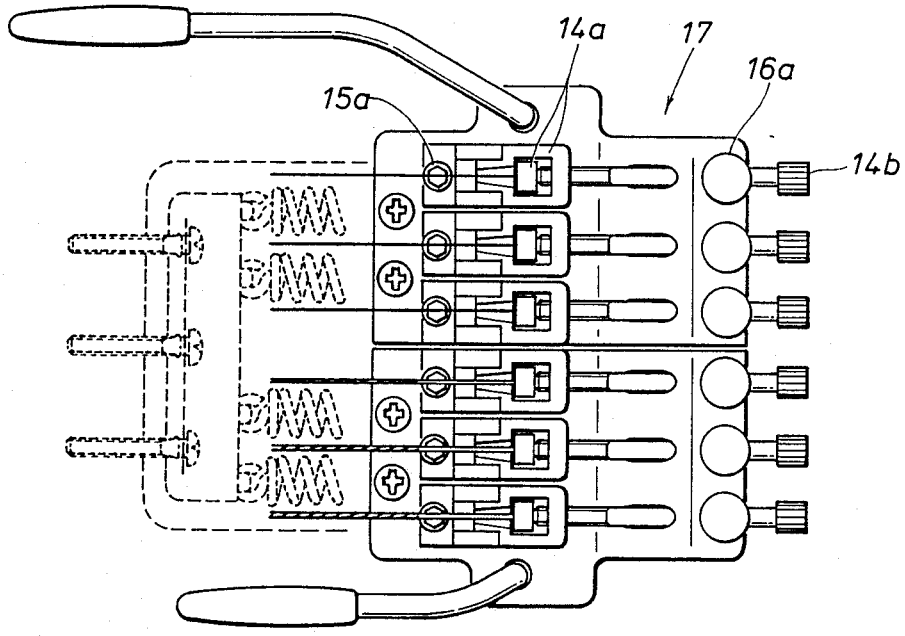
FIG. 9 is a view similar to FIG. 2 showing a third embodiment of the present invention.

FIG. 9 shows a third embodiment of the present invention. This embodiment differs from the first embodiment in the structure of the string tuning means mounted on the bridge base plate assembly 17. In this embodiment, string ends are fixed by pressing the string ends against the bridges 14 by way of clamp pieces 14*a* which are in turn pressed against the string ends by means of clamp screws 14*b*. The screws 16*a* secure these clamp screws 14*b*. The string tuning means further comprises string height adjusting screws 15*a*. The bridge base plate assembly 17 may be divided into two parts in the same way as in the preceding embodiments.

The bridge base plate assembly may be divided into a plurality of base plates to provide vibrato means according to the present invention. The strings may be divided into three or more groups, and the bridge base plate assembly or string support assembly may be accordingly divided into three or more bridge base plate segments or string support members. The bridge base plate segments may support different numbers of strings, such as two and four strings, respectively.

One or more of the divided bridge base plate segments may be fixed against swinging motion. The connector pin is not required to selectively connect and disconnect all of the bridge base plate segments but may selectively connect and disconnect some of the bridge base plate segments. Therefore, it is obvious to a person skilled in the art that the present invention can be implemented by selecting and/or combining the above described embodiments in any desired manner to produce a desired vibrato effect.

While the embodiments have been described as being applied to an electric guitar, it is obvious to a person skilled in the art that the present invention can be equally applied to other stringed musical instruments such as acoustic guitars, steel string guitars, and the like.

What we claim is:

1. A tremolo device for a stringed musical instrument, comprising:

a string support assembly pivotally mounted on the musical instrument body;

a plurality of bridge means mounted on the string support assembly;

spring means for biasing the string support assembly in opposition to the tension of the strings; and handle means for imparting vibrato effects to the spring support assembly;

the string support assembly comprising at least one individually pivoted segments, each carrying at least one of the bridge means, one of the spring means, and one of the handle means.

2. A device as defined in claim 1, the at least two segments of the string support assembly are pivoted by a common pivot center line extending perpendicularly to the strings.

3. A device as defined in claim 2, wherein the bridge means comprise means for adjusting the length of the corresponding individual string.

4. A device as defined in claim 2, wherein the handle means comprise a plurality of lever arms, one attached to each of the different segments of the string support assembly and extending substantially parallel to the strings.

5. A device as defined in claim 4, wherein one of the lever arms is longer than the other.

6. A device as defined in claim 2, further comprising means for selectively locking together the at least two segments of the string support assembly into a single body.

* * * * *

UNITED STATES PATENT AND TRADEMARK OFFICE

CERTIFICATE OF CORRECTION

PATENT NO. : 4,782,732

DATED : November 8, 1988

INVENTOR(S) : Hisashi Kato, Daiji Okai, Nobuyuki Yoshiba, Yukihisa Yuasa

It is certified that error appears in the above-identified patent and that said Letters Patent is hereby corrected as shown below:

Column 4, line 19 delete "convention" and insert --conventional--.

Column 6, line 20 delete "one" and insert --two--.

Signed and Sealed this

Seventeenth Day of October, 1989

*Attest:*

DONALD J. QUIGG

*Attesting Officer*

*Commissioner of Patents and Trademarks*